United States Patent [19]

Pozdneev et al.

[11] 3,983,088

[45] Sept. 28, 1976

[54] COATING FOR LOCAL PROTECTION OF PARTS

[76] Inventors: Viktor Timofeevich Pozdneev, ulitsa Textilschikov, 4, kv. 87; Mikhail Lvovich Khina, Malaya Kalitnikovskaya, ul., 5, kv. 48; Dmitry Vasilievich Bashkirov, ul. Tatyany Makarovoi, 10, kv. 5; Nikolai Fedorovich Judin, Sevastopolsky prospekt, 14, kv. 223; Nikolai Sergeevich Kobzev, Volzhsky bulvar, 20, kv. 90, all of Moscow, U.S.S.R.

[22] Filed: June 22, 1972

[21] Appl. No.: 265,182

[30] Foreign Application Priority Data

June 22, 1971 U.S.S.R. ..... 1672186

[52] U.S. Cl. ..... 260/24; 106/239; 260/33.6 EP; 260/37 EP

[51] Int. Cl.[2] ..... C08L 93/00

[58] Field of Search ..... 260/24, 400; 106/218, 106/239

[56] References Cited

UNITED STATES PATENTS

| | | | |
|---|---|---|---|
| 2,864,782 | 12/1958 | Mitchell | 260/24 |
| 2,868,767 | 1/1959 | Cyba | 260/24 |
| 2,898,352 | 8/1959 | Schenck | 260/400 |
| 3,459,566 | 8/1969 | Wilson | 106/218 |

*Primary Examiner*—Lewis T. Jacobs
*Assistant Examiner*—William E. Parker
*Attorney, Agent, or Firm*—Holman & Stern

[57] ABSTRACT

The proposed coating contains (in weight per cent);

| | |
|---|---|
| boric anhydride | 15–30, |
| silicon carbide | 15–35, |
| epoxy resin | 1–10, |
| rosin | 25–50, |
| benzene | the rest. |

2 Claims, No Drawings

COATING FOR LOCAL PROTECTION OF PARTS

The present invention relates to coatings for local protection of parts during their chemical heat treatment.

The invention can be efficiently employed in any field of machine building industry when manufacturing parts which are subject to chemical heat treatment, particularly to case-hardening and nitro-case-hardening, and needing local protection against saturation with carbon and nitrogen.

Known in the art is a coating comprising boric anhydride for local protection of parts against saturation with carbon and nitrogen during chemical heat treatment processes.

The prior-art coating contains up to 40 weight per cent of boric anhydride and did not make possible having an advance stock of parts for the production process, because the coating, when applied to parts usually deteriorates after 8–10 hours of storage in the air even before loading parts into a furnace for chemical heat treatment and also partly dissolves (up to 50 per cent) in quenching oil, causing oil contamination.

It is therefore an object of the present invention to provide a coating for local protection of parts against saturation with carbon and nitrogen during chemical heat treatment processes, which coating retains its protective properties for periods of up to 300 hours following application.

It is a further object of the present invention to provide such a coating of a composition which would prevent contamination of quenching oil in which the coated part is dipped after having been subjected to chemical heat treatment.

These and other objects are achieved by providing a coating for local protection of parts against saturation with carbon and nitrogen during chemical heat treatment, said coating comprising boric anhydride. The coating, according to the invention contains (in weight per cent):

| | |
|---|---|
| boric anhydride | 15–30, |
| silicon carbide | 15–35, |
| epoxy resin | 1–10, |
| rosin | 25–50, |
| benzene | the rest. |

This composition makes it possible to provide a coating which is easily applicable to parts, capable of long-term retention on the surface of parts (up to 300 hours), readily removable by flushing in a washing machine and is insoluble in quenching oil.

It is most expedient to provide a coating containing (in weight per cent):

| | |
|---|---|
| boric anhydride | 30, |
| silicon carbide | 15, |
| epoxy resin | 6, |
| rosin | 40, |
| benzene | 9. |

The invention disclosed herein is made more discernible by the description of its actual embodiment given hereinafter.

A coating for local protection of parts against saturation with carbon and nitrogen during chemical heat treatment according to the invention is characterized in that it contains (in weight per cent):

| | |
|---|---|
| boric anhydride | 15–30, |
| silicon carbide | 15–35, |
| epoxy resin | 1–10, |
| rosin | 25–50, |
| benzene | the rest. |

Boric anhydride and silicon carbide are used as a protection base in the coating, according to the present invention.

Apart from that, boric anhydride permits easy removal of the coating upon chemical heat treatment, by way of mere flushing.

With the content of boric anhydride less than 15 per cent, occurrence is possible of spot saturation of parts with carbon or nitrogen and also of hampered removal of the coating by flushing performed after chemical heat treatment.

The boric anhydride content larger than 30 per cent is not economically reasonable.

Silicon carbide is used as a filler and gives the coating additional protective properties.

With the silicon carbide content less than 15 per cent, protection of parts against saturation with carbon or nitrogen can not be guaranteed.

The silicon carbide content higher than 35 per cent is not economically reasonable.

Epoxy resin imparts plasticity to the coating. The resin content higher than 10 per cent increases the coating drying period.

Rosin being dissolved in benzene constitutes a binder.

Toluene can be used as an alternate solvent, possessing the properties similar to those of benzene.

The most preferable composition of the coating is as follows (in weight per cent):

| | |
|---|---|
| boric anhydride | 30, |
| silicon carbide | 15, |
| epoxy resin | 6, |
| rosin | 40, |
| benzene | 9. |

The above composition ensures quick and technologically simple application of coating to parts and, guarantees protection of parts against saturation with carbon or nitrogen during chemical heat treatment at a coating thickness of 0.3–0.4 mm.

The coating density is valued as 1.3 g/cm$^2$.

Parts which have been prepared for chemical heat treatment by application of the above coating can be kept in the air for up to 300 hours, with the coating retaining its protective properties during said period.

What is claimed is:

1. A coating for local protection of parts against saturation with carbon and nitrogen during chemical heat treatment of said parts, containing (in weight per cent):

| | |
|---|---|
| boric anhydride | 15–30, |
| silicon carbide | 15–35, |
| epoxy resin | 1–10, |
| rosin | 25–50, |

-continued

| | |
|---|---|
| benzene | the rest. |

2. A coating for local protection of parts against saturation with carbon and nitrogen during chemical heat treatment of said parts, containing (in weight per cent):

| | |
|---|---|
| boric anhydride | 30, |
| silicon carbide | 15, |
| epoxy resin | 6, |
| rosin | 40, |
| benzene | 9. |

* * * * *